US005595313A

United States Patent [19]

Kröll et al.

[11] Patent Number: 5,595,313

[45] Date of Patent: Jan. 21, 1997

[54] CRANE, PARTICULARLY A TRACK-BOUND MOBILE CRANE

[75] Inventors: Joachim Kröll, Jüchen; Peter Richter, Bergheim, both of Germany

[73] Assignee: Mannesmann Aktiengesellschaft, Düsseldorf, Germany

[21] Appl. No.: 380,067

[22] Filed: Jan. 30, 1995

[30] Foreign Application Priority Data

Jan. 31, 1994 [DE] Germany ..... 44 02 905.5

[51] Int. Cl.[6] ..... E01B 29/02

[52] U.S. Cl. ..... 212/225; 104/3; 212/226; 212/230

[58] Field of Search ..... 104/2, 3, 4; 414/542, 414/543, 392; 212/167, 224, 225, 230, 231, 238, 304, 314, 317, 312, 226

[56] References Cited

U.S. PATENT DOCUMENTS

| | | | |
|---|---|---|---|
| 453,089 | 5/1891 | McNeely | 212/231 |
| 1,821,340 | 9/1931 | Guilbert et al. | 104/3 |
| 3,682,332 | 8/1972 | Fearon | 212/167 |
| 4,232,610 | 11/1980 | Theurer | 212/224 |
| 4,234,287 | 11/1980 | Lassig et al. | 212/314 |
| 4,249,467 | 2/1981 | Theurer et al. | 104/3 |
| 5,106,255 | 4/1992 | Motoda et al. | 212/238 |

FOREIGN PATENT DOCUMENTS

| | | | |
|---|---|---|---|
| 2535359 | 5/1984 | France | 104/3 |
| 2646185 | 10/1990 | France | 104/2 |
| 105549 | 5/1974 | German Dem. Rep. . | |
| 2555676 | 6/1977 | Germany . | |
| 3201041 | 7/1983 | Germany . | |
| 3227157 | 1/1984 | Germany . | |

*Primary Examiner*—Thomas J. Brahan
*Attorney, Agent, or Firm*—Cohen, Pontani, Lieberman, Pavane

[57] ABSTRACT

A crane for raising and lowering a load, which crane includes a vehicle frame with end areas and a slewing device arranged on the vehicle frame. The slewing device includes at least two basic slewing columns slewable by 360°, mounted on the vehicle frame in the vehicle frame end areas. Additionally, a separate articulated slewing arm having at least two elements is located on each basic slewing column.

11 Claims, 5 Drawing Sheets

CRANE, PARTICULARLY A TRACK-BOUND MOBILE CRANE

BACKGROUND OF THE INVENTION

1. Field of the Invention

The invention relates to a crane, particularly a track-bound mobile crane, with a slewing device arranged on a vehicle frame for a load to be picked up and set down again.

2. Discussion of the Prior Art

Cranes of the mobile type, such as street cranes or track-bound cranes, are known which have a superstructure located centrally or almost centrally on the undercarriage, whereby various drive units, such as diesel engines and hydraulic pumps, are arranged on the rotatable superstructure (DE-OS 32 27 157).

However, cranes of this type can only be used for jobs in a limited fashion, as determined by the jib head. For example, the jib head is equipped with a telescopic jib, the reach of which is, however, determined by the center of gravity of the entire vehicle. It is therefore not possible to transport particularly long loads on the one hand and loads of smaller dimension that are short and heavy on the other.

SUMMARY OF THE INVENTION

Accordingly, it is an object of the present invention to provide a crane, particularly a mobile crane, which can be universally used for a large number of jobs, various lengths of load and various load sizes. The focus is to be especially on the functions needed in track and bridge construction.

According to the invention, this object is attained in a crane having a slewing device that consists of at least two basic slewing columns, slewable by 360 degrees, which are mounted, respectively, on the vehicle frame in the two vehicle frame end areas centric or equidistantly eccentric to the central longitudinal axis of the Vehicle frame. Additionally, an articulated slewing arm with at least two elements is attached to each basic slewing column. Such a crane is especially suitable for long and heavy loads, such as occur in track and bridge construction, for example.

In another embodiment of the invention, along with the eccentric basic slewing columns, at least one guidance carrier for trolleys, which extends in the longitudinal direction, is supported on the vehicle frame. The crane hereby serves on the one hand as a transport vehicle, while on the other hand the guidance carrier represents an additional element for later permitting the transport of long and heavy loads.

Advantageously, the guidance carrier is equipped with trolleys on both cross-sectional sides. This makes it possible to hang and carry long and heavy construction parts or loads symmetrically on the underside of the guidance carrier.

In a further embodiment of the invention, a gripper for catching and holding the guidance carrier is attached to each slewing arm in a rotary-adjustable manner. The load on the guidance carrier can therefore be swung out via the slewing arms as desired toward one side or the other, i.e., picked up and set down again.

Additionally, the basic slewing columns are height-adjustable. This height adjustability performs a double function, in that both the guidance carrier and the load can be adjusted in height.

In yet a further embodiment of the invention, each of the basic slewing columns is located on a rotatable platform on the vehicle frame. This facilitates the setting of slewing angles in the horizontal, so that the guidance carrier can be set not only parallel to the travelling direction of the crane, but also obliquely in the sense of a curve.

The invention is further improved by the fact that for the transport of the crane, two guidance carriers are stacked one atop the other on the vehicle frame and that during use the two guidance carriers are connectable to one another arranged one behind the other by means of the slewing devices. In this way, the greatest possible length of the load pick-up means is achieved.

For displacement of the center of gravity outside of the crane support area, it is further advantageous that in the area of the slewing devices, on both sides on the vehicle frame, struts with supporting plates are provided which can be swung out on arms.

Furthermore, jobs can be supervised or carried out and directed in that there is an operator cabin arranged in each of the vehicle end areas eccentric to the central longitudinal axis of the vehicle frame. Here it is advantageous that the two operator cabins are arranged on the same longitudinal side of the vehicle frame.

An advantageous organization of the structural space available on the crane is furthermore achieved by providing ballast weights or ballast tanks on the vehicle frame between the slewing devices.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
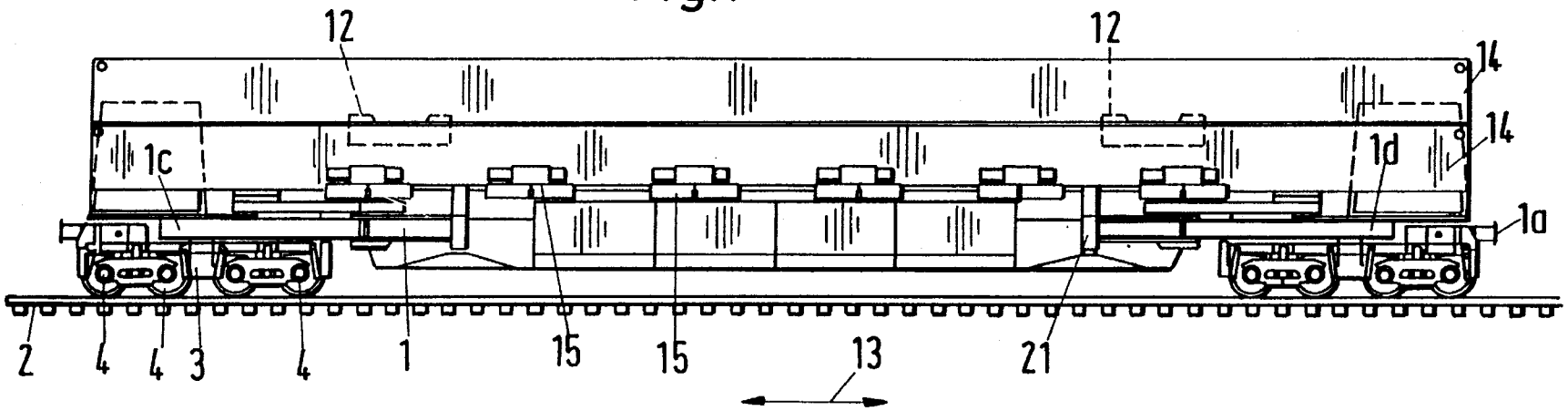
FIG. 1 is a side view of the inventive crane in transport status.
Figure 3:
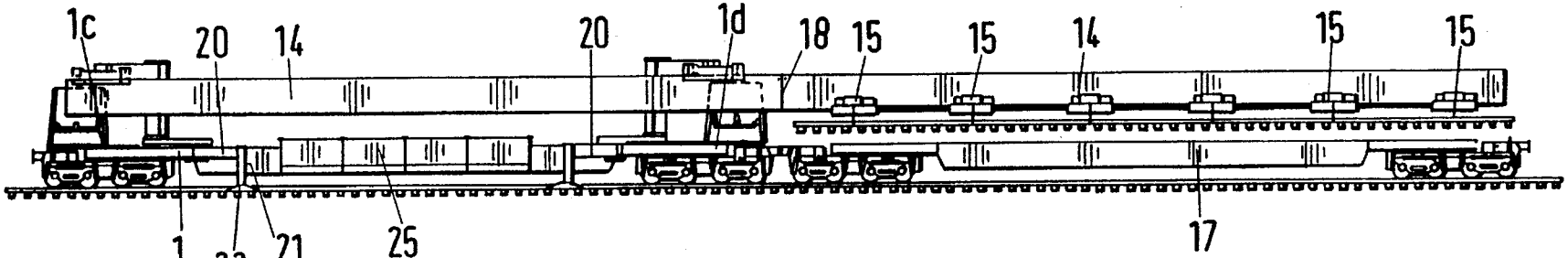
FIG. 3 is a side view of the crane in operation, working with two guidance carriers connected to one another.
Figure 4:
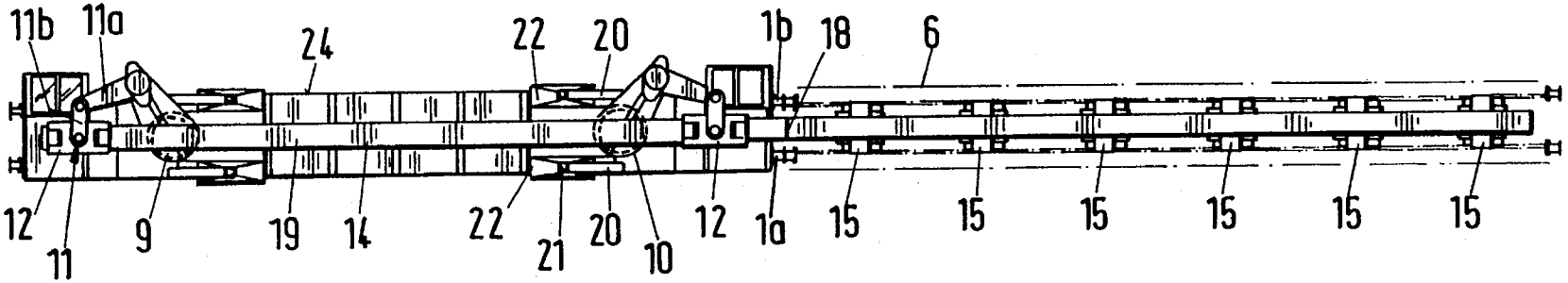
FIG. 4 is a top view on the operating status of the crane as in FIG. 3.
Figure 14:
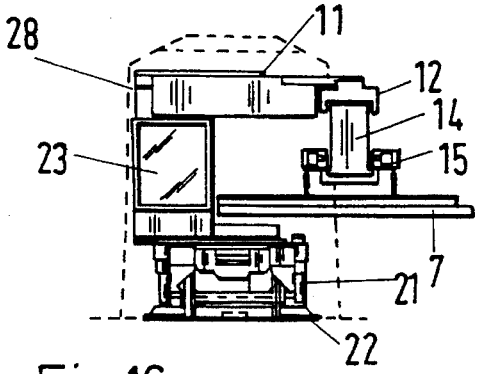
Figure 15:
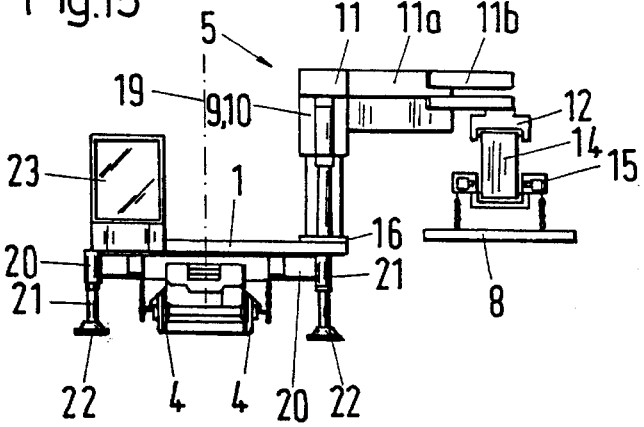

The crane, particularly a railway crane, has a vehicle frame 1 with buffers 1*a* and 1*b* and can be moved on track pairs 2 by means of bogies 3 with wheel sets 4 (FIG. 1). On the vehicle frame 1 there are slewing devices 5 for loads that are to be picked up and set down again, such as, for example, sections of track 6 (track with cross-ties; FIGS. 3 and 4)

having lengths of, for example, 24 m, switch elements 7 and the like (FIGS. 13 and 14), and cross-ties 8 (FIG. 15).

Figure 5:
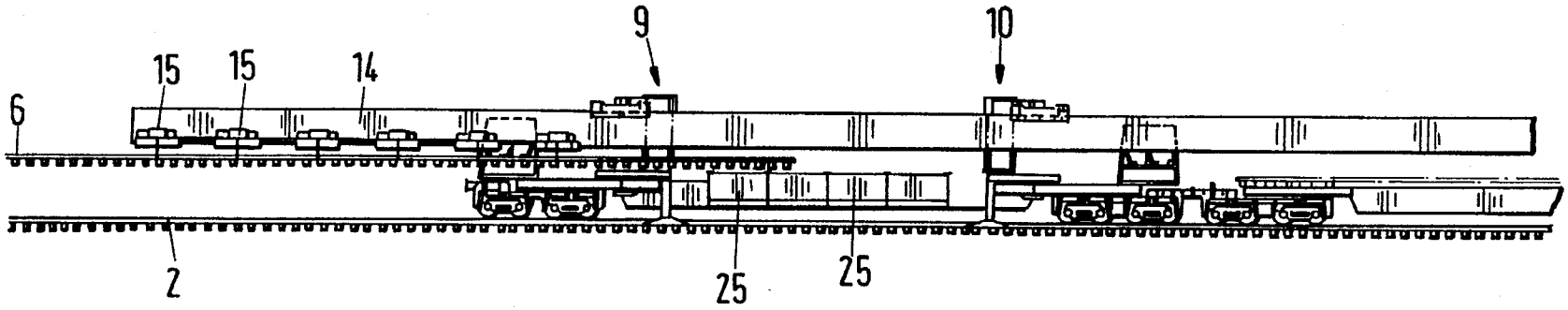
FIG. 5 is a side view of the crane during the job, whereby the two guidance carriers are connected to one another in a different direction.

The slewing device 5 consists of at least two basic slewing columns 9, 10, which are mounted in the two vehicle frame end areas 1*c* and 1*d* either centric (FIGS. 3, 5 and 7) or at equal distances 1*e* eccentric to the central longitudinal axis 19 of the vehicle frame. Each basic slewing column 9, 10 carries an articulated slewing arm 11 with at least two elements. The arm element 11*a* and the arm element 11*b* are connected, respectively, to the basic slewing columns 9, 10. The last arm element 11*b* carries a gripper 12 for catching and holding a guidance carrier 14 extending in the longitudinal direction 13 for multiple trolleys 15. The guidance carrier 14 at first rests through its weight on the vehicle frame 1, whereby two guidance carriers 14 can be stacked one atop the other (FIG. 1). The guidance carrier 14 is equipped on both cross-sectional sides 14*a*, 14*b* (FIG. 2) with the trolleys 15. The gripper 12 is rotatably attached to the last arm element 11*b*.

Figure 2:
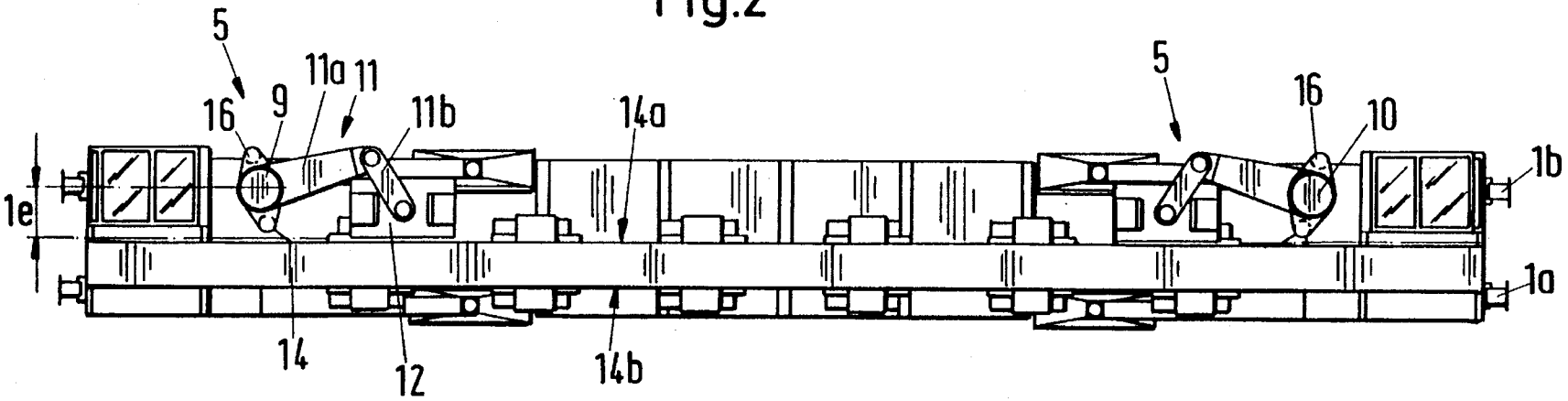
FIG. 2 is a top view of the crane as in FIG. 1.

The basic slewing columns 9, 10 are height-adjustable and may, for example, consist of telescoping units. At the same time, these basic slewing columns 9, 10 are respectively rotatably mounted on a rotatable platform 16 on the vehicle frame 1. FIGS. 1 and 2 show the crane in its transport position, while in the application shown in FIGS. 3 and 4 the guidance carriers 14 are arranged one behind the other by means of an auxiliary carriage 17 and a connection 18. The crane (-carriage) and the auxiliary carriage 17 are thereby coupled to one another, i.e., the buffers 1*a*, 1*b* stand against one another.

Struts 21 are attached in the area of the slewing devices 5, respectively, on both sides on the vehicle frame. The struts 21 have attached supporting plates 22 and can be swung out on arms 20.

Figure 6:
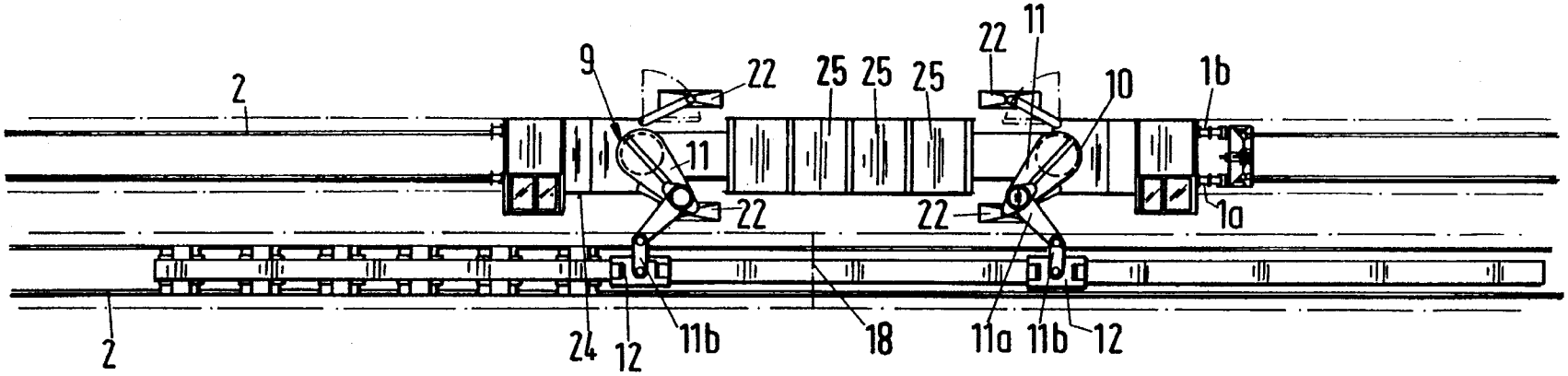
FIG. 6 is a top view of the working example of the crane as in FIG. 5.

After the guidance carriers 14 have been connected one behind the other, they hang in the slewing devices 5 and can therefore (FIGS. 5 and 6), for example, be swung over the track of a track pair 2 that is to be laid parallel. For this purpose, the particular track section 6 hangs on the cable-trolleys or trolleys 15. At this stage, the slewing arms with the arm elements 11*a* and 11*b*, to which the grippers 12 are attached, are swung out accordingly. All work steps are controlled from one of the operator cabins 23 located respectively in the vehicle frame end areas 1*c*, 1*d* eccentric to the central longitudinal axis 19 of the vehicle frame. Advantageously, the two operator cabins 23 are arranged on the same longitudinal side 24 (FIGS. 4, 6 and 8) of the vehicle frame 1. In addition, ballast weights or ballast tanks 25 are attached to the vehicle frame 1 between the slewing devices 5.

Figure 7:
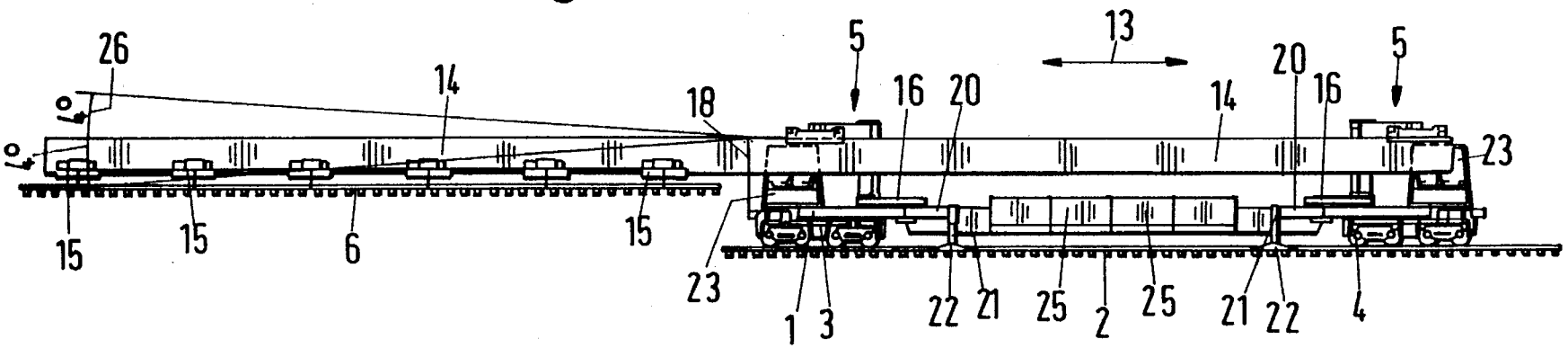
FIG. 7 is an additional example of the crane, in side view, with height-adjustment of the slewing devices.
Figure 8:
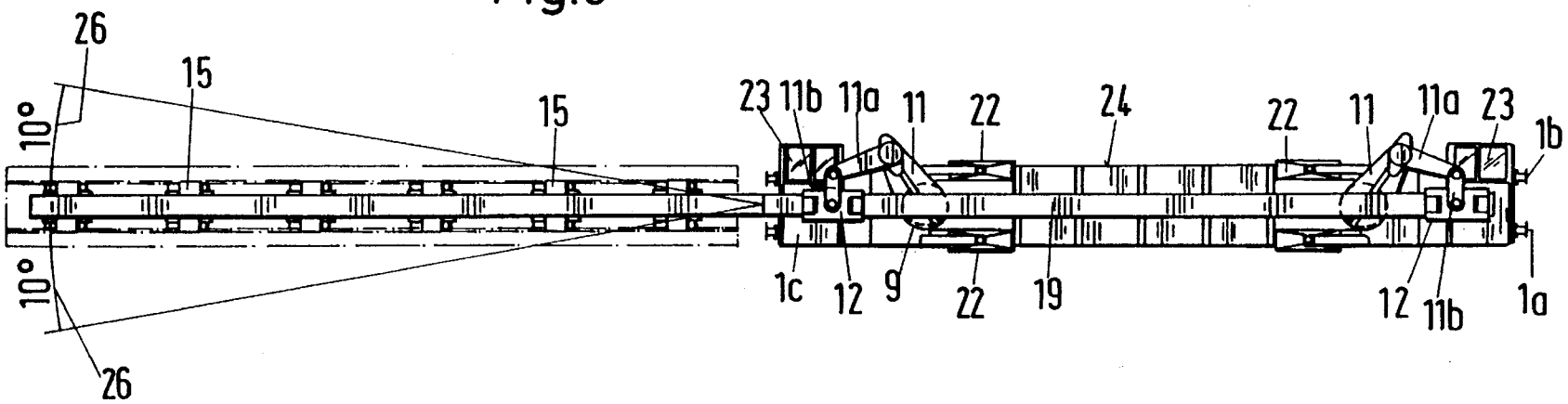
FIG. 8 is a top view for FIG. 7, with another possible use, for example, of the crane for curved runs.

In order to lay the track sections 6 on curves, the slewing devices 5 are slewed individually on the platform 16; and to set the angles 26 on up-grades and down-grades, the basic slewing columns 9, 10 are held individually or telescoped (FIGS. 7 and 8).

Figure 9:
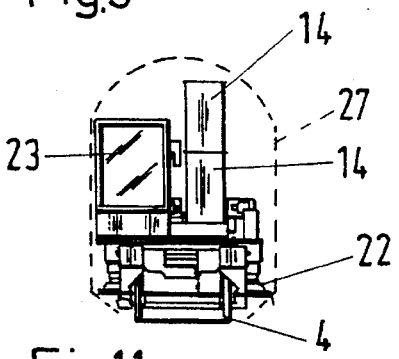
FIGS. 9–16 respectively show a front view of individual work steps or transport positions.
Figure 10:
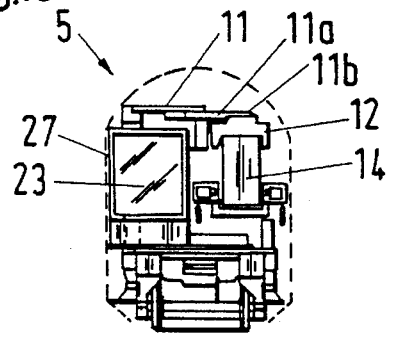

The crane is especially suitable for internationally prescribed gauges 27. In the transport position (FIG. 9), the operator cabin 23 and the stacked guidance carriers 14, in particular, are located within the gauge 27. Individual guidance carriers 14 may also remain in the transport position on the slewing devices 5, the basic slewing columns 9 and 10, the slewing arms 11 with arm elements 11*a*, 11*b*, as well as on grippers 12 including the trolleys 15 (FIG. 10).

Figure 11:
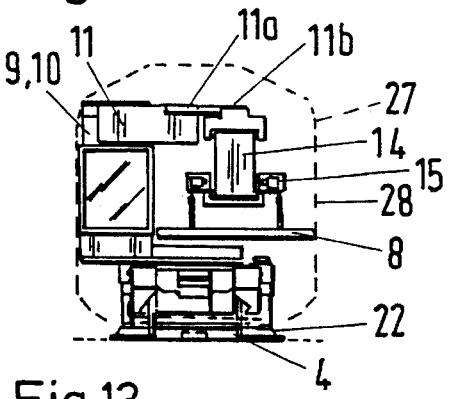
Figure 12:
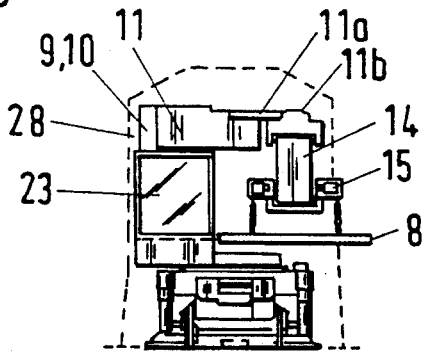

Gauges 28 according to various national regulations also accommodate, along with the components already mentioned, cross-ties 8 on the trolleys 15 (FIGS. 11 and 12).

Figure 13:
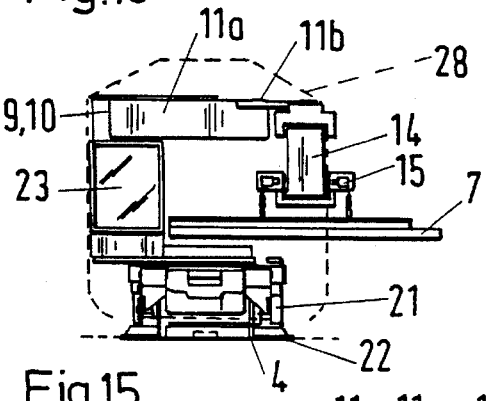

In addition, complete switch elements 7 can be carried within the gauge 28 or 29 (FIGS. 13 and 14).

Figure 16:
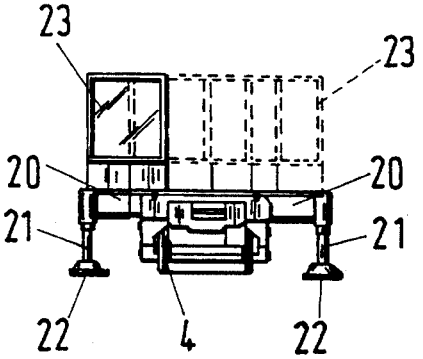

For the installation of cross-ties (FIGS. 15 and 16), the arms 20 with the struts 21 and supporting plates 22 are swung out on both sides of the vehicle frame 1, so that the slewing devices 5 located over the struts 21 are fully supported. The complete extended outswing of the slewing arms 11 and the arm elements 11*a*, 11*b* can hereby be taken advantage of.

We claim:

1. A crane for raising and lowering a load, comprising: a vehicle frame having end areas and a central longitudinal axis; a slewing device arranged on the vehicle frame, the slewing device including at least two basic slewing columns, slewable by 360°, one of the slewing columns being mounted on the vehicle frame in each of the vehicle frame end areas; a separate double-link articulated slewing arm having at least two elements that are connected together to be pivotable relative to one another about a vertical axis and in a horizontal plane, located on each basic slewing column; at least one guidance carrier arranged on the vehicle so as to extend in the longitudinal direction of the vehicle; trolleys arranged on both cross-sectional sides of the guidance carrier; and gripper means attached to each of the slewing arms in a rotary-adjustable manner for catching and holding the guidance carrier.

2. A crane as defined in claim 1, wherein the basic slewing columns are arranged on the central longitudinal axis of the vehicle frame.

3. A crane as defined in claim 1, wherein the basic slewing columns are arranged on the vehicle frame at equal distances eccentric to the central longitudinal axis of the vehicle frame.

4. A crane as defined in claim 1, wherein the at least one trolley guidance carrier is arranged on the vehicle frame next to the slewing columns.

5. A crane as defined in claim 1, wherein the basic slewing columns are adapted to be adjustable.

6. A crane as defined in claim 1, and further comprising rotatable platforms respectively provided on the vehicle frame for each of the basic slewing columns, each slewing column being mounted on one of the rotatable platforms.

7. A crane as defined in claim 1, and further comprising two guidance carriers provided so as to be stackable atop one another on the vehicle frame for crane transport, and connectable to one another end to end by the slewing device to permit use of the guidance carriers.

8. A crane as defined in claim 1, and further comprising a plurality of struts each having a supporting plate, and swingable arms pivotally arranged near the slewing columns on both sides of the vehicle frame, the struts being connected to the swingable arms so that the struts and plates can be moved out from the frame by swinging the swingable arms.

9. A crane as defined in claim 1, and further comprising two operator cabins, each operator cabin being respectively arranged in one of the vehicle frame end areas eccentric to the central longitudinal axis of the vehicle frame.

10. A crane as defined in claim 9, wherein the two operator cabins are arranged on a common longitudinal side of the vehicle frame.

11. A crane as defined in claim 1, and further comprising ballast weights arranged on the vehicle frame between the slewing columns.

* * * * *